United States Patent [19]

Hadary

[11] 3,994,039

[45] Nov. 30, 1976

[54] TOOTHBRUSH

[76] Inventor: Joseph Hadary, 5405 Linden Court, Bethesda, Md. 20014

[22] Filed: Apr. 1, 1975

[21] Appl. No.: 564,074

[52] U.S. Cl. ..... 15/172; 15/167 R

[51] Int. Cl.[2] ..... A46B 9/10

[58] Field of Search ..... 15/167, 171, 172, 176, 15/144 R, 144 A, 144 B

[56] References Cited

UNITED STATES PATENTS

| | | | |
|---|---|---|---|
| 2,002,320 | 5/1935 | Jones | 15/172 |
| 2,091,716 | 8/1937 | Petta | 15/172 |
| 2,427,411 | 9/1947 | Krueger | 15/172 |
| 3,886,618 | 6/1975 | Padletti | 15/172 |

FOREIGN PATENTS OR APPLICATIONS

| | | | |
|---|---|---|---|
| 649,074 | 8/1928 | France | 15/172 |

*Primary Examiner*—Peter Feldman
*Attorney, Agent, or Firm*—Shoemaker and Mattare, Ltd.

[57] ABSTRACT

A toothbrush having a bristle supporting head pivotally mounted to a handle for pivotal movement of the head and bristles about a pivot axis substantially perpendicular to the axis of the handle to a plurality of positions to gain easy access to tooth surfaces at opposite sides of the mouth.

4 Claims, 24 Drawing Figures

TOOTHBRUSH

BACKGROUND OF THE INVENTION

This invention relates to dental equipment for promoting oral hygiene and, in particular, relates to a unique and improved toothbrush for effecting more thorough cleansing of teeth and gum areas near the base of the teeth. With prior art toothbrushes it is very difficult to effectively clean the gingival margins and sulcus areas, particularly in difficult to reach portions of the mouth, because of the fixed relationship of the bristles to the handle, and also due to the large size of the bristles and handle. Further, the construction of prior art toothbrushes makes it necessary to tilt the handle both horizontally and vertically in order to reach certain areas of the teeth.

The importance of cleaning not only the tooth surfaces, but also of cleaning the gingival crevice of massaging the gums is clearly evident when it is recognized that diseases of the gums, such as gingivitis, for example, afflict approximately 65 percent of the nation's school children, and in adults, at the age of 40 for example, nearly 100 percent have some form of tooth or gum disease. If the teeth were properly cleaned, the bacteria which cause tooth and gum diseases could be significantly reduced, if not eliminated, and the incidence of disease reduced accordingly.

One of the most common and widely used dental instruments for cleaning the teeth and gums is the toothbrush, but unfortunately, for the reasons suggested above, the toothbrush is not frequently used correctly, and according to one report, the toothbrush and its use is probably responsible for only a 10 percent reduction in tooth and gum diseases.

In this connection, there are many widely recognized and proven methods for using a toothbrush, and such methods include the vertical, rolling, Fones, Stillman and Charters methods. Whichever the method used, it is desirable to thoroughly clean the interproximal areas of the teeth, as well as the buccal and lingual surfaces, and the sulcus areas at the base of the teeth. Also the occlusal surfaces of the teeth should be thoroughly cleaned. However, due to the natural arc of the teeth, and the fact that the teeth have both concave and convex surfaces and the teeth are of different sizes, on both upper and lower jaws, and teeth are frequently malposed, all tooth surfaces are usually not effectively cleaned. Also, the buccal surfaces of the posterior teeth are particularly difficult to clean because of the inward pressure of the cheek against these teeth.

Many attempts have been made in the prior art to devise a toothbrush capable of performing satisfactorily all of the above functions. However, most efforts in this regard have been directed toward different bristle configurations, whereby the bristles are constructed such that they more readily enter the interproximal areas or the gingival margins at the base of the teeth. However, even with such prior art constructions, it is very difficult to reach the lingual surfaces of the lower anterior teeth, and the buccal surfaces of the posterior teeth, as well as the gingival crevice of the posterior teeth. For example, when attempting to brush the lingual surfaces of the lower anterior teeth, it is necessary with prior art toothbrush constructions to elevate the handle of the toothbrush in order that access of the bristles to the lingual surfaces of the anterior teeth can be gained. This, of course, is awkward for anyone to do, and is particularly difficult for persons suffering from arthritis or other ailments which renders it difficult for them to elevate their arms above certain positions, and it is also difficult for children to manipulate the handle in a proper manner to gain proper access to the various surfaces of the teeth. Consequently, such persons, including small children, frequently do not brush the difficult to reach surfaces of the teeth, and the incidence of disease is thereby increased.

OBJECTS OF THE INVENTION

Accordingly, it is an object of this invention to provide a toothbrush having a unique construction which provides for easy access of the bristles to all of the surface areas of the teeth in a person's mouth.

Another object of the invention is to provide a toothbrush having a pivotal head carried by the handle thereof, such that the head may be pivoted to a plurality of positions, and in each of said positions, access to the lingual surfaces of the teeth on opposite sides, respectively, of the mouth is greatly enhanced, and wherein the handle is small and is configured whereby it may be readily grasped and rotated or twirled with the fingers.

A further object of the invention is to provide a toothbrush having a pivotal head thereon which is offset from the handle axis, whereby the handle and bristles in effect straddle the teeth, and access to all of the lingual and buccal surfaces of the teeth can be gained without requiring excessive elevation of the toothbrush handle and the like, thus rendering it much easier for all persons, and particularly infirm persons or small children, to gain access to those areas of the teeth.

A still further object of the invention is to provide a toothbrush having a removable head and bristles thereon, whereby heads having different bristle configurations can be quickly and easily attached to the handle for providing the best bristle configuration for particular cleaning operations to be performed on the teeth and gums, such as, for example, small bristle heads for reaching confined areas in the mouth.

DETAILED DESCRIPTION OF THE INVENTION

Figure 1:
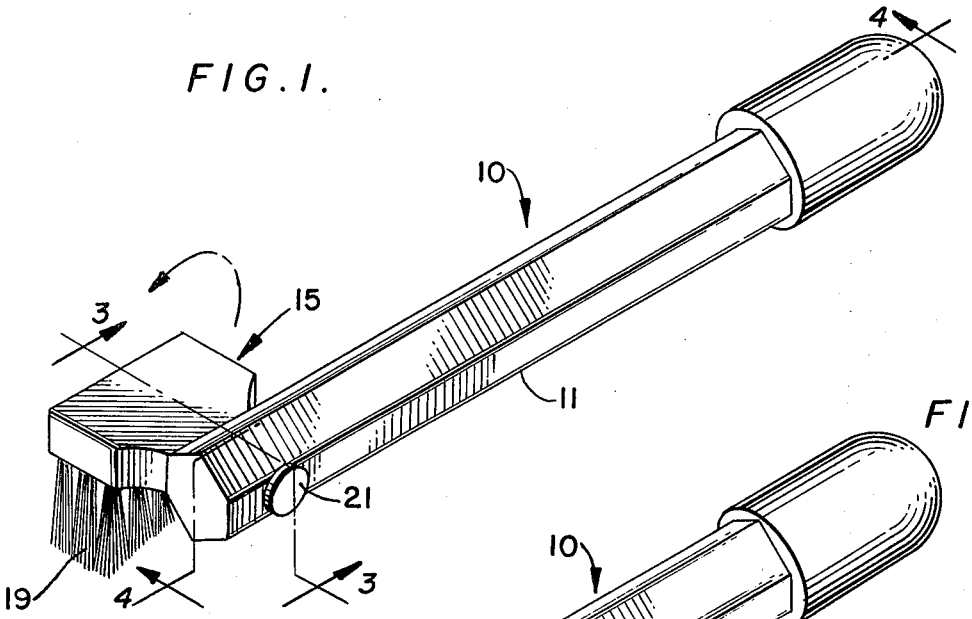
FIG. 1 is a perspective view of a first form of toothbrush in accordance with the invention.

In the drawings, wherein like reference numerals indicate like parts throughout the several views, a first form of toothbrush is indicated generally at 10 and comprises an elongate, substantially rigid handle 11 made of any suitable material, such as plastic or the like, and preferably having a polygonal cross-section or, more particularly, and as shown, a hexagonal cross-section. The handle has a longitudinally extending, coaxial bore 12 therein opening through opposite ends of the handle, and one end of the bore is closed by a cap 13 suitably fixed in said one open end of the bore in a conventional manner, such as by glue or cement and the like. A transverse opening 14 also extends through said one end of the handle and communicates with the bore 12 therein. A head means 15 is pivotally connected to said one end of the handle 11 and comprises a substantially rectangularly shaped body 16, having a front face 17 and rear face 18, and a plurality of suitable bristles 19 affixed to the body 16 and extending from the front face thereof in a conventional and well-known manner. A spindle 20 extends from one side of the body 16 and may be either formed integrally therewith or formed separately and then permanently affixed thereto, as desired. The spindle 20 extends through the opening 14 in the handle 11 and a retaining cap 21 is fitted on the end of spindle 20 to retain the spindle and head in position on the handle 11. In this regard, both the spindle 20 and cap 21 rotate together in the opening 14. The spindle 20 has a transverse opening 22 therethrough located substantially on the center line or axis of the bore 12 through the body 11.

Figure 4:
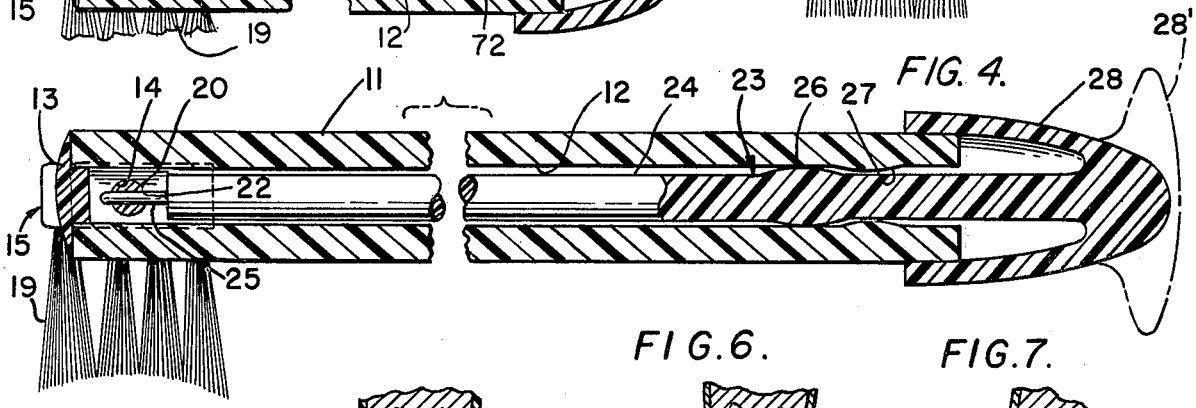
FIG. 4 is a view in section taken along line 4—4 in FIG. 1.

A head retaining means 23 comprises an elongate rod 24 extended coaxially through the bore 12 in the handle 11, and having a reduced diameter pin 25 extended from one end thereof and received through the bore or opening 22 in the spindle 20 of the head means 15, such that the spindle and thus the head are prevented from rotating. Detent means is provided on the other end of the rod 24 for retaining it in position in the body, and comprises an enlargement 26 on the rod which is frictionally retained behind a shoulder or restricted portion 27 in the bore 12. A cap 28 or the like is integral with the outer end of the rod and is received over the end of body 11, as shown in FIG. 4. Also, as shown in FIG. 4 in phantom line, the cap 28' may be enlarged to form a pad which may be braced against the palm of the hand during use of the brush to facilitate the use thereof.

Figure 2:
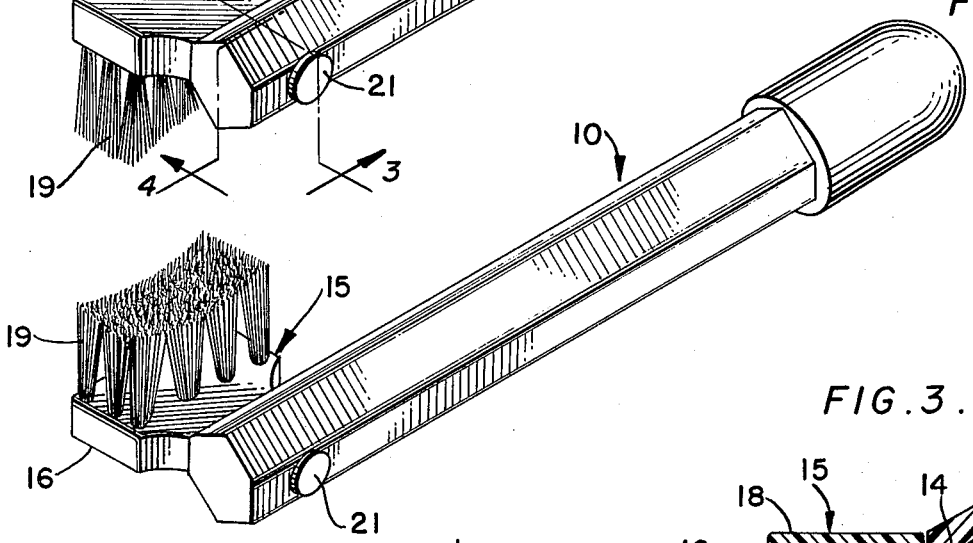
FIG. 2 is a view similar to FIG. 1, with the head and bristles of the brush in a different position.

Thus in use, the cap 28 may be grasped and retracted to draw the enlargement 26 past the restricted portion 27 and thus to withdraw the pin 25 from the opening 22 in spindle 20, releasing the spindle 20 for rotation in the opening 14 from one position, as shown in FIG. 1, to a second position, as shown in FIG. 2, and the rod 24 may then be advanced to extend the pin 25 through the opening 22 from the other side of the spindle to latch or retain the head in the second position as shown.

If desired, the cap 21 may be removed, whereby the head means can be withdrawn from the handle and different head means having different bristle configurations thereon can be substituted or attached to the handle.

Figure 5:
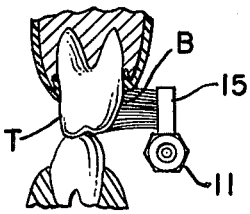
FIGS. 5, 6 and 7 are schematic views illustrating various areas of the teeth to be cleaned.
Figure 6:
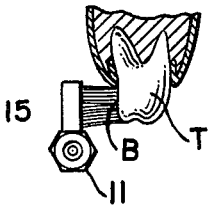
Figure 7:
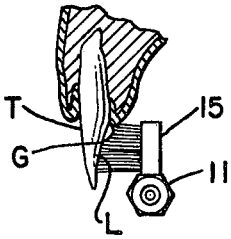

As seen in FIGS. 5, 6 and 7, the toothbrush according to the present invention is ideally constructed for effectively cleaning the teeth, and in FIG. 5 the bristles are shown in contact with the buccal surface of a tooth T, while in FIG. 7 the bristles are shown in contact with the lingual surface of a tooth T, and the bristles are properly positioned for also cleaning the gingival crevice G at the base of the tooth.

Figure 8:
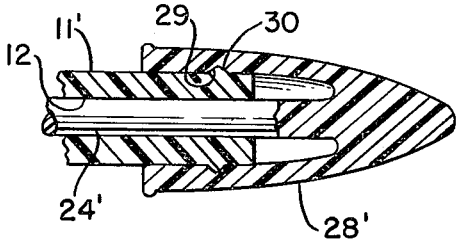
FIG. 8 is a fragmentary, enlarged, sectional view of a portion of the toothbrush handle and rod according to the invention, showing a modified means of retaining the rod in position relative to the handle.

In FIG. 8 a modified detent for the rod is shown, and in this form of the invention the cap 28' has an annular groove or recess 29 therein, which cooperates with an annular rib or detent 30 on the outer surface of the handle 11', and the rod 24' has a smooth exterior surface and extends slidably through the bore 12 in the handle 11'. In all other respects the construction and operation of the toothbrush are as previously described.

Figure 9:
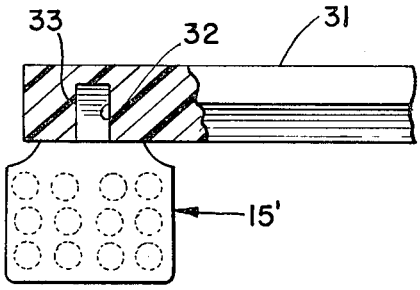
FIG. 9 is a fragmentary view with parts thereof in section of a further modification, wherein the head is frictionally retained to the handle.
Figure 10:
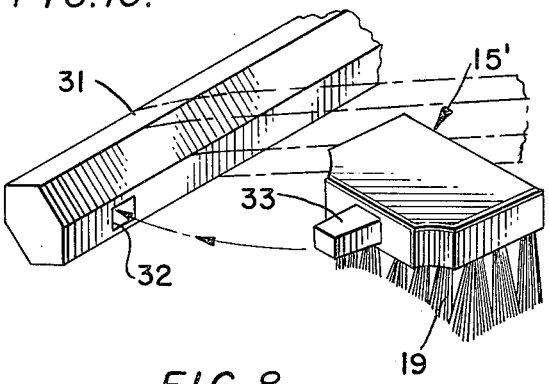
FIG. 10 is a fragmentary, exploded, perspective view of the modification of FIG. 9.

In FIGS. 9 and 10 a third modification of the invention is illustrated, and in this form of the invention an elongate, solid handle 31 has a polygonal cross-sectional configuration and a transverse bore or opening 32 in one end thereof, in which a complementary shaped spindle or stub 33 of a head means 15' is frictionally received. In use, the head 15' is grasped and pulled to remove the stub 33 from the opening 32 and the head is pivoted or rotated 180° from the position shown in FIG. 9, and the stub 33 reinserted into the opening 32, whereat frictional engagement between the outer surface of the stub 33 and the inner wall surface of the opening 32 retains the head 15' in operative position on the handle 31. The handle may be curved as indicated in phantom line to even further facilitate access to hard to reach areas of the mouth.

Figure 11:
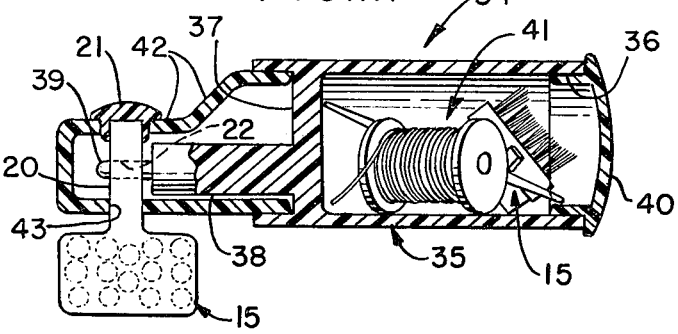
FIG. 11 is a longitudinal sectional view of a still further modification of the invention.

A fourth modification 34 as illustrated in FIG. 11, and in this form of the invention the handle comprises an elongate, hollow body 35 having an open end 36 and a closed end 37, with a laterally offset, axially extending, reduced diameter rod 38 projecting integrally from the closed end 37, and a further reduced diameter, axially extending pin 39 projecting from the tip end of the rod 38. A removable closure cap 40 is frictionally engaged in the open end 36 of the body 35 for retaining therein suitable dental materials 41, such as dental floss, toothpicks and the like. The handle also includes a forward end portion 42 having a transverse opening 43 therethrough, in which the spindle 20 of a toothbrush head means 15 is rotatably received. A suitable cap 21 is engaged on the end of spindle 20 to retain the spindle and head means in operative position relative to the handle end portion 42, and the cap 21 rotates with the spindle and head means 15, as previously described. Also, a transverse opening 22 is formed through the spindle 20 and through which the pin 39 extends to retain the spindle and head means in axially rotatably adjusted positions, as previously described.

Figure 12:
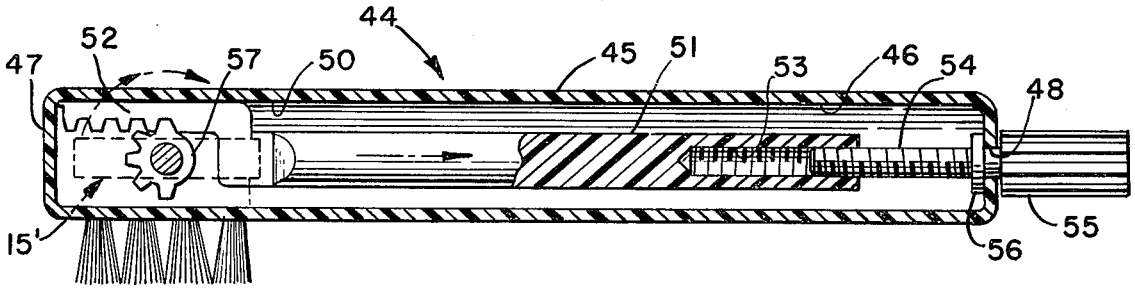
FIG. 12 is a longitudinal sectional view of yet another modification of the invention, wherein the adjustment of the head is gear controlled.
Figure 13:
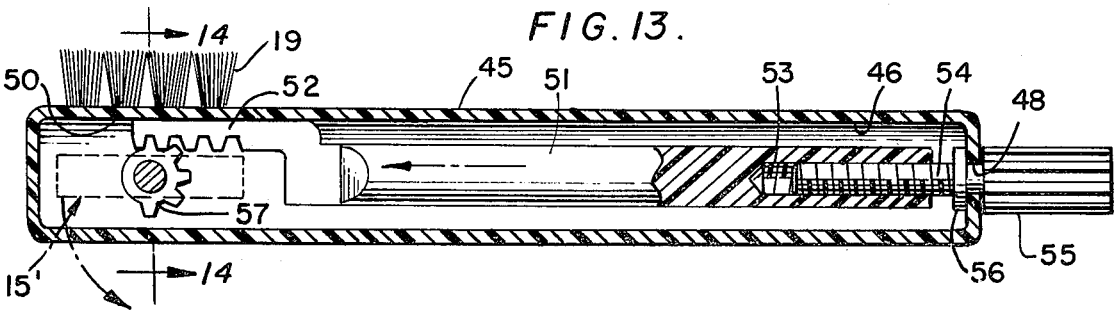
FIG. 13 is a view similar to FIG. 12, showing the head and bristles in a different position.
Figure 14:
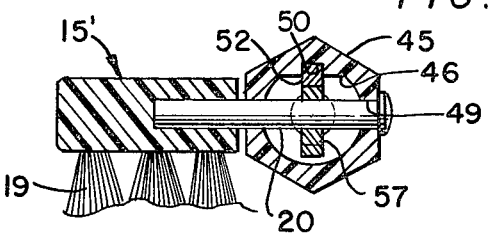
FIG. 14 is a view in section taken along line 14—14 in FIG. 13.

A fifth modification of the invention is illustrated in FIGS. 12, 13 and 14, and in this form of the invention the toothbrush 44 comprises an elongate, tubular handle 45 having an enlarged bore 46 extended therethrough throughout substantially the entire length thereof, and the handle has a closed forward end 47 and an open rearward end 48. The handle 45 also has a transverse opening 49 extending therethrough adjacent said forward end thereof, and a longitudinally extending channel 50 in an inner surface of one side of the handle. The retaining means in this form of the invention comprises an elongate rod 51 extended coaxially within the bore or opening 46, and having an offset, forwardly extending gear means or rack 52 at one end thereof, with one edge portion of the rack 52 slidably disposed in the channel 50. The other end of the rod 51 is internally threaded at 53 and an externally threaded actuating screw 54 is threadably received in the internally threaded opening 53 of rod 51, and the actuating screw extends through the opening 48 and has an enlarged, roughened, finger gripping portion 55 externally of the handle 45 and an enlarged collar 56 internally of the handle adjacent opening 48 to restrain the screw against axial movement, whereby upon rotation of the finger gripping portion 55 the screw threaded actuator 54 is rotated and the rod 51, which is restrained against rotation by engagement of the rack 52 in channel 50, is thus caused to reciprocate, as indicated by the arrows in FIGS. 12 and 13. A head means 15' having bristles 19 thereon and a spindle 20 projecting from one side thereof is pivotally connected to the forward end of the handle 45, and the spindle 20 has a gear means or pinion 57 either formed integrally therewith or securely attached thereto in registration with the rack 52, whereby upon reciprocation of the rod 51 and rack 52, the spindle 20 and thus head means 15' is caused to rotate, as indicated by the arrows in FIG. 12.

Figure 3:
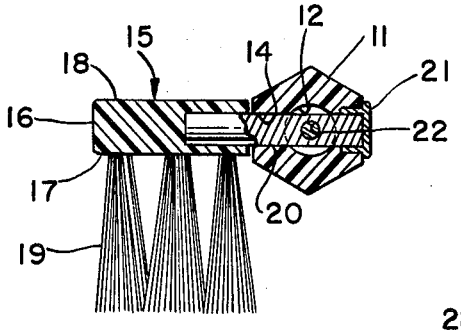
FIG. 3 is a sectional view taken along line 3—3 in FIG. 1.
Figure 15:
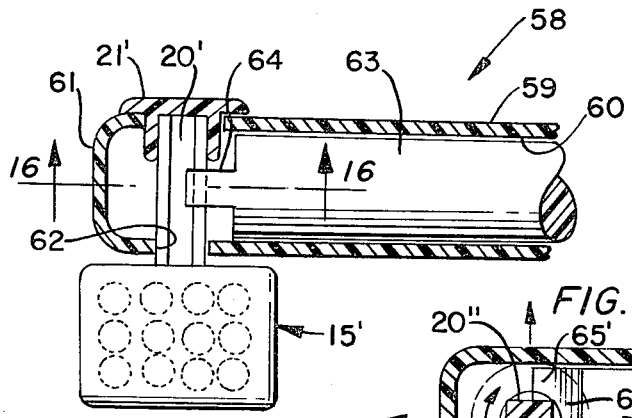
FIG. 15 is an enlarged, fragmentary, sectional view of a still further modification of the invention.
Figure 16:
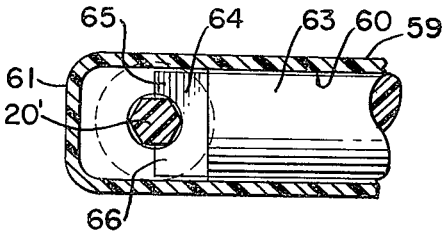
FIG. 16 is a view in section taken along line 16—16 of FIG. 15.

A sixth modification of toothbrush is indicated generally at 58 in FIGS. 15 and 16, and comprises a handle 59 having an enlarged bore or opening 60 therethrough and a closed forward end 61, with a transverse opening or bore 62 extended through the handle adjacent the closed end thereof. A rod or retaining means 63, with a bifurcated end portion 64 comprising a pair of spaced apart, forwardly extending, parallel legs 65 and 66 is reciprocably received in the bore 60, and is retained in a reciprocated position by any of the means described hereinabove, such as the cap 28 in FIGS. 1–4, or the cap 28' of FIG. 8, or the threaded means of FIGS. 12 and 13. The spindle 20' of the head means 15' of the toothbrush is polygonal in cross-section, and as shown, is hexagonally shaped and is retained in the opening 62 by means of a cap 21', in the manner as described with relation to FIGS. 1–3, and the shape and size of the spindle 20' is complemental to the shape and size of the concave opening defined by the bifurcated legs 65 and 66, such that when the rod 63 is in a forward position, as illustrated in FIGS. 15 and 16, the concave shape between the legs 65 and 66 engages the spindle 20' to retain it and the head means 15' against rotation.

Figure 17:
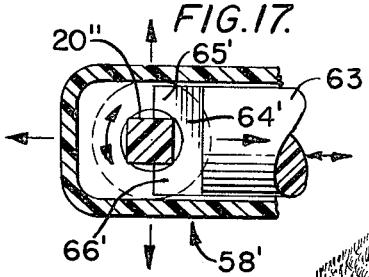
FIG. 17 is a view similar to FIG. 16 of yet another modification of the invention.

A seventh modification of the invention is indicated at 58' in FIG. 17 and is substantially similar to the form of the invention in FIGS. 15 and 16, except that the legs 65' and 66' of the bifurcated end 64' of the rod 63 define a concavity having substantially a rectangular or square configuration for cooperation with a similarly configured spindle 20'', such that the spindle can be rotated and retained in four different positions spaced approximately 90° apart, as indicated by the arrows in FIG. 17. Thus, not only can the bristles be retained in position with the axes of the bristles extending at a right angle to the axis of the handle, but the bristles can also be retained in a position with their axes extending parallel to the axis of the handle.

Figure 18:
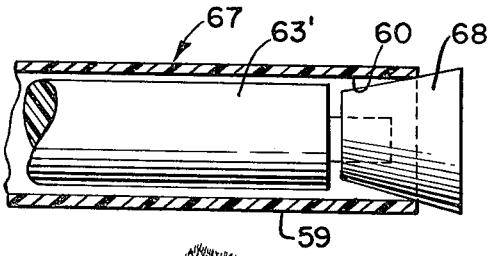
FIG. 18 is an enlarged, fragmentary, sectional view of a portion of the handle and rod and retaining means for the rod of yet another modification of the invention.

In FIG. 18 an eighth modification of the invention is indicated at 67, and this form of the invention is similar to any of those described in relation to FIGS. 1–4, FIG. 8 or FIGS. 15–17, and rather than the particular retaining means described in relation to those figures, a stopper type detent or retainer 68 is affixed either integrally or otherwise to the end of rod 63' and is frictionally engaged in the open end of bore 60 through the handle 59.

Figure 19:
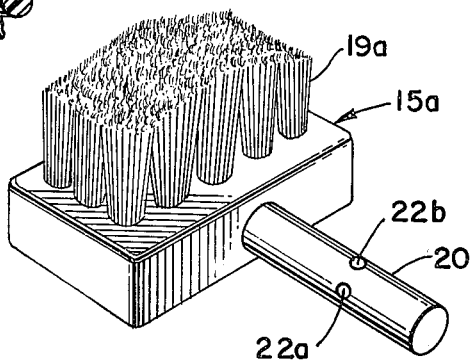
FIGS. 19, 20 and 21 are perspective views of different possible bristle configurations for use with the toothbrush of the invention.
Figure 20:
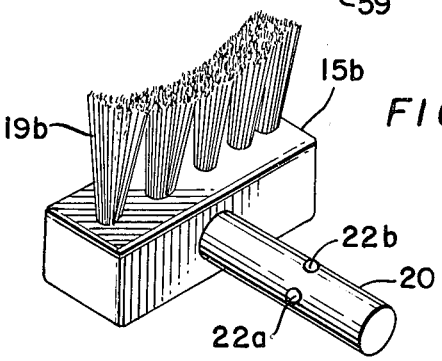
Figure 21:
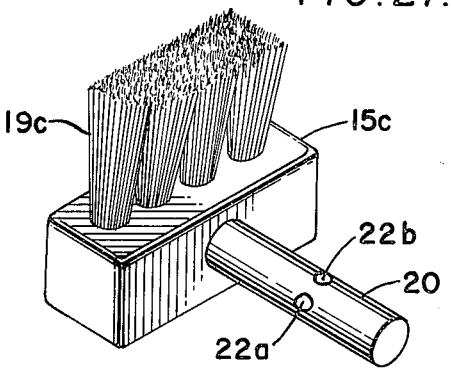

In FIGS. 19, 20 and 21, three different head means **15*a*, 15*b* and 15*c* are illustrated, each having a differently configured bristle arrangement 19*a*, 19*b* or 19*c* thereon for specialized purposes in cleaning teeth. Any of these heads and bristles may be used with any of the handle means previously described, except that with regard to the FIGS. 12–14 and FIGS. 15–17 modifications the spindles 20 would have to be suitably modified in order to be usable with the retaining means as shown in those figures. Further, the spindles 20 may have two holes 22*a* and 22*b* therethrough at right angles to one another, whereby the head may be locked in each of four positions, as in FIG. 17**, for example.

Figure 22:
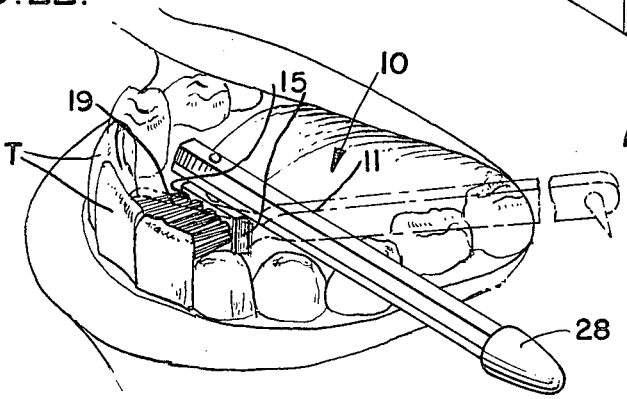
FIG. 22 is a schematic perspective view illustrating the manner in which the brush may be used to clean the lingual surfaces of the lower anterior teeth, without requiring elevation of the brush handle.

In FIG. 22 the brush 10 is shown being used to clean the lingual surfaces of the lower anterior teeth T, and as seen, the bristles 19 of the head 15 are properly positioned for effective cleaning of the lingual surfaces of the teeth, with the handle 11 disposed with its axis substantially parallel to the plane of the occlusal surfaces of the teeth, or in other words, it is not necessary to elevate the handle 11 in order to reach the lingual surfaces of the lower anterior teeth, as is necessary with prior art toothbrushes. A typical prior art toothbrush is shown in phantom line and the tilt or elevation of the handle necessary to gain access to the lingual surfaces of the teeth is clearly shown.

Figure 23:
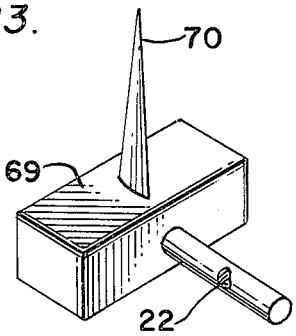
FIG. 23 is a perspective view of a modified head for use with the handle of any of the forms of the invention, wherein rather than bristles, a particularly shaped tooth pick is carried by the head.

In FIG. 23, a modified head 69 is shaped similarly to the bristle or brush heads previously described, but rather than bristles, a flat, generally knife-blade-shaped tooth pick 70 of plastic or other suitable material is affixed thereto. With this head attached to one of the previously described handles, the tooth pick 70 may quite readily be inserted into the interproximal areas of the posterior teeth from the lingual side thereof.

Figure 24:
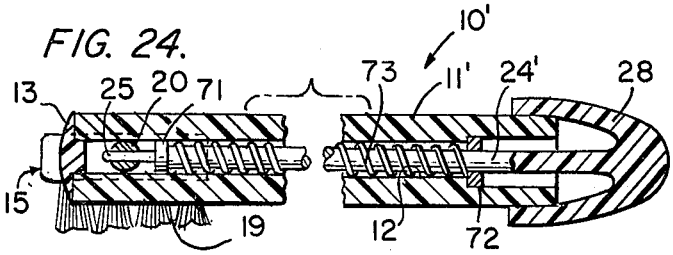
FIG. 24 is a view in section, on a reduced scale, of a modified locking means for the bristle head.

In FIG. 24, a further modification of the invention is indicated generally at 10', and comprises an elongate handle 11', as previously described, having an axial bore 12 therethrough and a spindle 20 of a bristle head 15 received therein, as in the FIGS. 1–4 embodiments. A modified rod 24' extends from a cap 28 through the bore and terminates in a pin 25 operatively engaged with spindle 20. A spring retainer collar 71 is suitably formed or secured on rod 24' adjacent the pin 25, and a spring retainer or abutment 72 is suitably secured in the bore near the end of handle 11', as by cement or a press fit or the like, and a coil spring 73 is received between the spring retainers 71 amd 72 to normally urge the rod and pin to the left as viewed in FIG. 24 to lock or retain the bristle head in an adjusted position. By grasping the cap 28 and pulling to the right, the pin is retracted from the spindle to free the bristle head for adjustment to a different position or replacement with a different head.

The various components of the toothbrushes described herein may be made of any suitable material, such as synthetic plastic and the like, and the spindles may be made integrally with the bodies of the head means or made separately and suitably affixed thereto, as with glue or the like, as desired, and the spindles may comprise plastic or metal or other suitable material, and similarly, the rods and pins may comprise integrally formed pieces or separately formed pieces permanently secured together and may be made of materials such as metal or plastic and the like. Moreover, the bristles for the various head means may be made either hard, medium or soft and of various synthetic or natural bristle materials as is known in the art, whereby many different types of head and bristle configurations and materials may be provided for specialized purposes.

Moreover, while only one handle has been shown as having a curvature thereto, any of the handles described herein may be curved, if desired, and any of the spindles 20 may have two holes **22*a* and 22*b*** therethrough, if desired.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A toothbrush, comprising: an elongate tubular handle having opposite end portions and having an axial bore extending completely therethrough; a bristle head pivotally carried by the handle at one of the ends, said bristle head comprising a body having a spindle projecting from one side thereof; said one end of said handle having a pair of diametrically opposed, transversely extending openings therein in communication with said bore; the spindle of said bristle head releasably pivotally received in said aligned openings from one side of said handle for pivotal movement of the head about a pivot axis substantially perpendicular to the axis of the handle; bristles on said bristle head projecting therefrom in a direction mutually perpendicular to the handle axis and pivot axis; head retaining means releasably engaged with an end of said spindle releasably retaining said spindle in said aligned openings whereby said head may be readily removed; an elongate rod extending longitudinally of said handle through said bore and axially slidable therein; an axially projecting spindle engaging means on one end of said rod releasably engageable with said spindle to retain the spindle and thus the head in each of a plurality of pivotally adjusted positions, including two positions at least 180° apart; said rod projecting at its other end beyond the other end of the handle; a first closure cap on said other end of said rod and slidably engageable on said other end of the handle at the exterior surface of the handle to close said bore at said other end; a second closure cap on said one end of the handle closing the bore at said one end; axially spaced apart spring retaining means in the bore of the handle carried respectively by the rod and by the handle; and a spring in the bore engaged between the spring retaining means urging the rod and spindle engaging means in a first direction toward the spindle and into engagement with the spindle to retain the head in adjusted position, said first cap axially removable from the handle to urge the rod and spindle engaging means in a second direction to disengage the spindle engaging means from the spindle to enable the head to be pivoted to another adjusted position.

2. A toothbrush as in claim 1, wherein the spindle has a transverse opening therein, and a reduced diameter pin extends axially from said one end of the rod, said pin insertable in said opening in the spindle to retain the head means in each of two adjusted positions spaced 180° apart.

3. A toothbrush as in claim 2, wherein the spring retaining means comprises a spring retaining collar on the rod near the pin end thereof, and a spring abutment is in the bore of the handle adjacent the other end of the handle, said spring engaged at its opposite ends with the collar and abutment.

4. A toothbrush as in claim 1, wherein the spring comprises a coil spring.

* * * * *